US008911070B2

(12) United States Patent
Song

(10) Patent No.: US 8,911,070 B2
(45) Date of Patent: Dec. 16, 2014

(54) SYSTEM FOR RECYCLING INKJET-PRINTING MATERIAL

(75) Inventor: Yu Song, Shenzhen (CN)

(73) Assignee: Shenzhen China Star Optoelectronics Technology Co., Ltd., Guangdong (CN)

( * ) Notice: Subject to any disclaimer, the term of this patent is extended or adjusted under 35 U.S.C. 154(b) by 201 days.

(21) Appl. No.: 13/379,010

(22) PCT Filed: Nov. 29, 2011

(86) PCT No.: PCT/CN2011/083096

§ 371 (c)(1),
(2), (4) Date: Dec. 17, 2011

(87) PCT Pub. No.: WO2013/071642

PCT Pub. Date: May 23, 2013

(65) Prior Publication Data

US 2013/0119080 A1 May 16, 2013

(30) Foreign Application Priority Data

Nov. 16, 2011 (CN) ..... 2011 1 0363909

(51) Int. Cl.

| | |
|---|---|
| ***B41J 2/18*** | (2006.01) |
| ***B41J 2/185*** | (2006.01) |
| ***B41J 2/165*** | (2006.01) |
| *B41J 2/195* | (2006.01) |

(52) U.S. Cl.

CPC ..... *B41J 2/16541* (2013.01); *B41J 2202/09* (2013.01); *B41J 2/195* (2013.01); *B41J 2/18* (2013.01)

USPC ..... 347/89; 347/90

(58) Field of Classification Search

CPC ..... B41J 2/18

USPC ..... 347/89

See application file for complete search history.

(56) References Cited

U.S. PATENT DOCUMENTS

| | | | | |
|---|---|---|---|---|
| 4,067,020 | A * | 1/1978 | Arway | 347/89 |
| 4,527,170 | A * | 7/1985 | Iwasaki et al. | 347/89 |
| 7,648,224 | B2 * | 1/2010 | Sasa et al. | 347/89 |

(Continued)

FOREIGN PATENT DOCUMENTS

| | | |
|---|---|---|
| CN | 1623677 | 6/2005 |
| CN | 1905951 | 1/2007 |

(Continued)

OTHER PUBLICATIONS

Machine generated English translation of JP2003-127435A to Kagami et al. "Inkjet Printer"; generated via http://www.ipdl.inpit.go.jp/homepg_e.ipdl on Oct. 3, 2013; 6 pp.*

Machine generated English translation of JP2006-062127A to Nakamura et al. "Cleaning Method"; generated via http://www.ipdl.inpit.go.jp/homepg_e.ipdl on Oct. 3, 2013; 9 pages.*

* cited by examiner

*Primary Examiner* — Shelby Fidler

(57) ABSTRACT

The present invention provides a system and a method for recycling an inkjet-printing material. The recycling method comprises the following steps: utilizing a wiper configured to withdraw the inkjet-printing material dispensed by the nozzles, and collecting the inkjet-printing material by means of a recycling tank; mixing a fresh inkjet-printing material with the inkjet-printing material collected by the recycling tank, so as to form a reuse inkjet-printing material; and providing the reuse inkjet-printing material to the nozzles. The present invention can greatly save the inkjet-printing material.

11 Claims, 2 Drawing Sheets

(56) References Cited

U.S. PATENT DOCUMENTS

| | | | | |
|---|---|---|---|---|
| 2002/0085076 | A1* | 7/2002 | Romano et al. | 347/89 |
| 2006/0141130 | A1 | 6/2006 | Kwon et al. | |
| 2007/0279465 | A1* | 12/2007 | Shindo | 347/89 |
| 2011/0069118 | A1* | 3/2011 | Ohzeki et al. | 347/44 |

FOREIGN PATENT DOCUMENTS

| | | | |
|---|---|---|---|
| CN | 101676038 | | 3/2010 |
| JP | 2003127435 | A * | 5/2003 |
| JP | 2006062127 | A * | 3/2006 |

SYSTEM FOR RECYCLING INKJET-PRINTING MATERIAL

FIELD OF THE INVENTION

The present invention relates to a recycling system and a method using the same, and more particularly to a system and a method for recycling an inkjet-printing material.

BACKGROUND OF THE INVENTION

Inkjet printers have been widely applied in electrical products. The inkjet printers can coat a uniform thin film on a substrate. For example, the inkjet printers can be used to coat alignment films on glass substrates of liquid crystal displays (LCDs).

In general, after coating the alignment films on the glass substrates, nozzles of the inkjet printers are required to dispense materials for test on a wiper, so as to prevent the nozzles from being stuck. However, at this time, the dispensed materials for test can not be reused, thus wasting the inkjet-printing material. Specifically, in a process for coating the alignment films, the material of the alignment films is very expensive, and thus a waste of the material of the alignment films will increase a manufacturing cost.

As a result, it is necessary to provide a system and a method for recycling an inkjet-printing material to solve the problems existing in the conventional technologies, as described above.

SUMMARY OF THE INVENTION

The present invention provides a system and a method for recycling an inkjet-printing material to solve the waste problem of the inkjet-printing material.

A primary object of the present invention is to provide a system for recycling an inkjet-printing material, comprising: a wiper configured to clean nozzles and to withdraw the inkjet-printing material dispensed by the nozzles; a recycling tank connected to the wiper and configured to collect the inkjet-printing material withdrew by the wiper; a mixing tank connected between the recycling tank and the nozzles and configured to mix a fresh inkjet-printing material with the inkjet-printing material collected by the recycling tank, so as to form and provide a reuse inkjet-printing material to the nozzles.

In one embodiment of the present invention, a predetermined mixture ratio of the inkjet-printing material from the recycling tank and the fresh inkjet-printing material in the mixing tank is in the range of 1:2 to 1:5

In one embodiment of the present invention, the recycling tank comprises a viscosity sensor configured to sense a viscosity of the inkjet-printing material in the recycling tank.

In one embodiment of the present invention, the viscosity of the inkjet-printing material provided from the recycling tank to the mixing tank is in a predetermined range.

In one embodiment of the present invention, the predetermined range is of 5 Mpa·s to 8 Mpa·s.

In one embodiment of the present invention, the system for recycling the inkjet-printing material further comprises a waste tank, wherein, when the viscosity of the inkjet-printing material in the recycling tank is beyond the predetermined range, the inkjet-printing material in the recycling tank is scrapped to the waste tank.

In one embodiment of the present invention, the system for recycling the inkjet-printing material further comprises a buffer tank configured to receive the reuse inkjet-printing material and another fresh inkjet-printing material, so as to provide a usable inkjet-printing material to the nozzles.

In one embodiment of the present invention, the recycling tank comprises a drying device configured to absorb the moisture content in the inkjet-printing material in the recycling tank.

Another object of the present invention is to provide a method for recycling an inkjet-printing material, comprising the following steps: withdrawing the inkjet-printing material dispensed by the nozzles and collecting the inkjet-printing material by means of a recycling tank; mixing a fresh inkjet-printing material with the inkjet-printing material collected by the recycling tank, so as to form a reuse inkjet-printing material; and providing the reuse inkjet-printing material to the nozzles.

In one embodiment of the present invention, the method further comprises the following steps: after collecting the inkjet-printing material by means of the recycling tank, detecting whether a viscosity of the collected inkjet-printing material in the recycling tank is in the predetermined range; when the viscosity of the inkjet-printing material in the recycling tank is in the predetermined range, providing the inkjet-printing material in the recycling tank for a mixing tank; and when the viscosity of the inkjet-printing material in the recycling tank is beyond the predetermined range, scrapping the inkjet-printing material in the recycling tank.

In comparison with the problem existing in the conventional inkjet-printing machine, the system and the method of the present invention for recycling the inkjet-printing material can efficiently recycle the unused inkjet-printing material for greatly saving the inkjet-printing material and reducing the cost of the inkjet-printing process.

The structure and the technical means adopted by the present invention to achieve the above and other objects can be best understood by referring to the following detailed description of the preferred embodiments and the accompanying drawings.

DETAILED DESCRIPTION OF THE PREFERRED EMBODIMENTS

Figure 1:
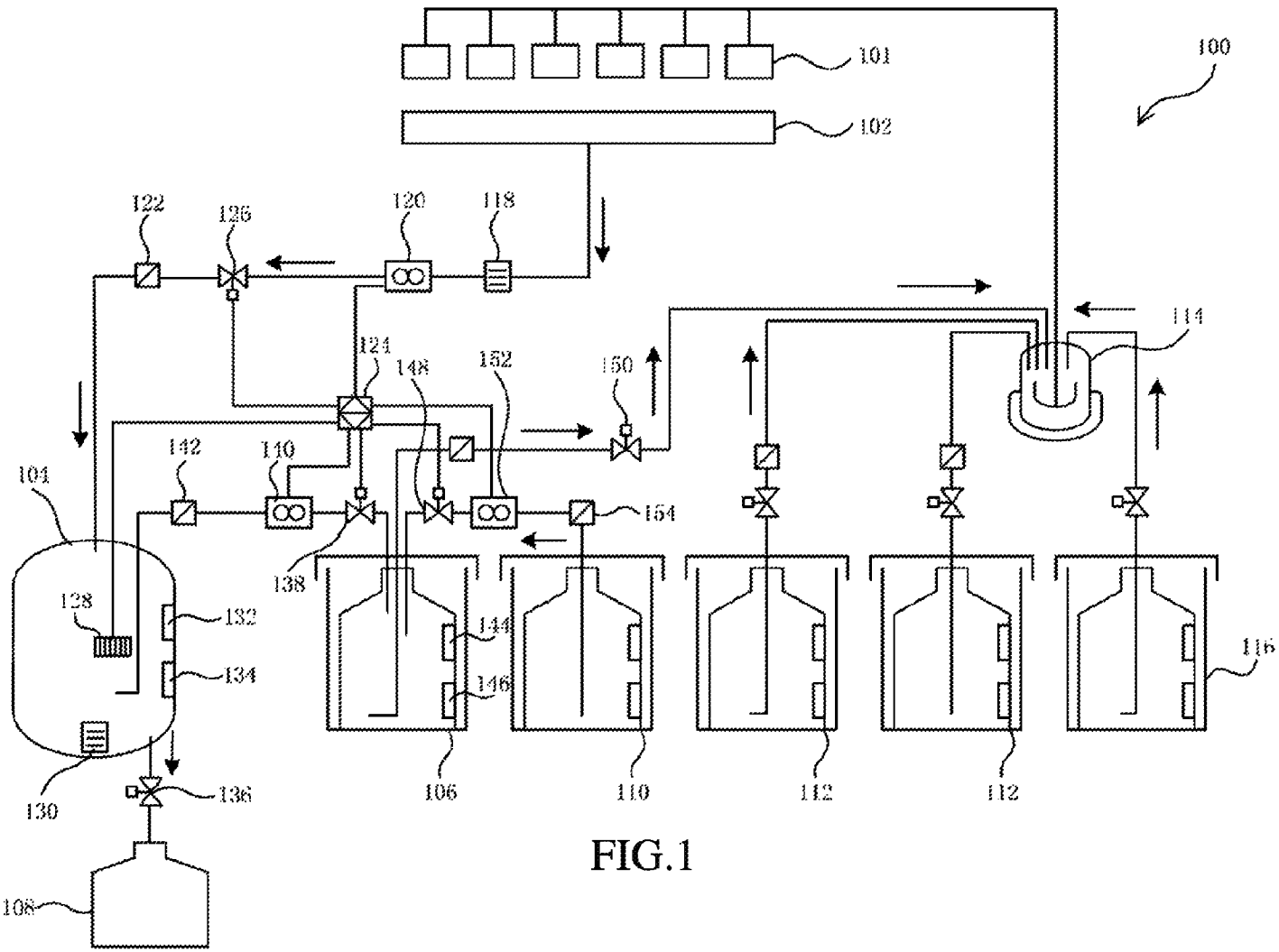
FIG. 1 is a schematic diagram showing a system for recycling an inkjet-printing material according to a preferred embodiment of the present invention.

The following embodiments are referring to the accompanying drawings for exemplifying specific implementable embodiments of the present invention. Furthermore, directional terms described by the present invention, such as upper, lower, front, back, left, right, inner, outer, side and etc., are only directions by referring to the accompanying drawings, and thus the used directional terms are used to describe and understand the present invention, but the present invention is not limited thereto.

In the drawings, structure-like elements are labeled with like reference numerals.

Referring to FIG. 1, a schematic diagram showing a system for recycling an inkjet-printing material according to a preferred embodiment of the present invention is illustrated. The system 100 for recycling the inkjet-printing material is configured to recycle the fluid material for inkjet-printing. In this embodiment, the material recycling system 100 is applicable to an inkjet-printing apparatus for coating alignment films, so as to recycle the fluid material (the inkjet-printing material) of the alignment films. However, the material recycling system 100 of the present invention can be applicable to an inkjet-printing apparatus in other coating processes for recycling other suitable fluid materials.

Referring to FIG. 1 again, the material recycling system 100 of the present embodiment comprises a wiper 102, a recycling tank 104, a mixing tank 106, a waste tank 108, a first fresh tank 110, at least one second fresh tank 112, a buffer tank 114 and a clean tank 116. The wiper 102 is configured to wipe and clean nozzles 101 of the inkjet-printing apparatus and to withdraw the inkjet-printing material dispensed by the nozzles 101. The recycling tank 104 is connected to the wiper 102 and for collecting the inkjet-printing material withdrew by the wiper 102. The mixing tank 106 is connected to the recycling tank 104 for mixing a fresh inkjet-printing material provided by the first fresh tank 110 with the inkjet-printing material collected by the recycling tank 104, so as to form and provide a reuse inkjet-printing material to the nozzles 101. The waste tank 108 is connected to the recycling tank 104 for receiving an unqualified waste fluid which is scrapped by the recycling tank 104. The first fresh tank 110 is connected to the mixing tank 106 for providing the fresh inkjet-printing material to the mixing tank 106 for mixing with the inkjet-printing material collected by the recycling tank 104. The second fresh tank 112 is conned to the buffer tank 114 for providing another fresh inkjet-printing material to the buffer tank 114. The buffer tank 114 is connected between the mixing tank 106 and the nozzles 101 for providing a usable inkjet-printing material to the nozzles 101, wherein the usable inkjet-printing material mixed by the mixing tank 106 is provided to the nozzles 101 by means of the buffer tank 114. The clean tank 116 is connected to the buffer tank 114 for providing a cleaning liquid to the buffer tank 114, so as to clean the buffer tank 114.

Referring to FIG. 1 again, the wiper 102 can include a suction device (not shown) configured to withdraw the inkjet-printing material dispensed by the nozzles for cleaning or dummy dispensing. The material recycling system 100 further comprises a drying device 118, a flow meter 120, a filter 122, a controller 124 and a valve device 126. The drying device 118, the flow meter 120, and the filter 122 are disposed between the wiper 102 and the recycling tank 104. The drying device 118 is configured to absorb the moisture content in the inkjet-printing material which is withdrew by the wiper 102. The flow meter 120 is configured to measure a flow rate of the inkjet-printing material from the wiper 102 to the recycling tank 104, and to provide a flow rate information to the controller 124. The filter 122 is configured to filter the impurities out the inkjet-printing material for enhancing the quality of thereof. The controller 124 may be a programmable logic controller (PLC) electrically connected to valve devices for controlling the valve devices to switch the channels between the tanks on/off. The valve device 126 may be an electromagnetic valve electrically connected to the controller 124 for switching the channel between the wiper 102 and the recycling tank 104 tanks on/off.

Referring to FIG. 1 again, the recycling tank 104 of the present embodiment comprises a viscosity sensor 128, a drying device 130, a high level detector 132 and a low level detector 134 disposed therein. The viscosity sensor 128 is configured to sense a viscosity of the inkjet-printing material in the recycling tank 104 and to inform the controller 124 about the viscosity information. When the viscosity of the inkjet-printing material in the recycling tank 104 is in a predetermined range, it indicates that the inkjet-printing material in the recycling tank 104 is recyclable. Contrarily, when the viscosity of the inkjet-printing material in the recycling tank 104 is beyond the predetermined range, the controller 124 can control the valve device 136 between the recycling tank 104 and the waste tank 108 to switch on for scrapping the inkjet-printing material from the recycling tank 104 to the waste tank 108. The drying device 130 is configured to absorb the moisture content in the inkjet-printing material in the recycling tank 104 for enhancing the quality thereof. The high level detector 132 and the low level detector 134 are electrically connected to the controller 124. When a liquid level of the inkjet-printing material in the recycling tank 104 is higher than a position of the high level detector 132, the controller 124 can control the valve device 126 between the wiper 102 and the recycling tank 104 to switch off. When the liquid level of the inkjet-printing material in the recycling tank 104 is lower than a position of the low level detector 134, the controller 124 can control the valve device 138 between the recycling tank 104 and the mixing tank 106 to switch off.

In this embodiment, the inkjet-printing material collected by the recycling tank 104 may be a polyimide (PI) liquid. At this time, the predetermined range of the viscosity of the inkjet-printing material can be 5 Mpa·s~8 Mpa·s, and preferably 6.0 Mpa·s~7.6 Mpa·s.

Referring to FIG. 1 again, the material recycling system 100 further comprises a valve device 138, a flow meter 140 and a filter 142. The valve device 138, the flow meter 140 and the filter 142 are disposed between the recycling tank 104 and the mixing tank 106. The valve device 138 and the flow meter 140 are electrically connected to the controller 124.

Referring to FIG. 1 again, the mixing tank 106 of the present embodiment comprises a high level detector 144 and a low level detector 146. The material recycling system 100 further comprises a valve device 148, a flow meter 152 and a filter 154. The valve device 148, the flow meter 152 and the filter 154 are disposed between the mixing tank 106 and the first fresh tank 110. The valve device 148 and the flow meter 152 are electrically connected to the controller 124. When a liquid level of the inkjet-printing material in the mixing tank 106 is higher than a position of the high level detector 144, the controller 124 can control the valve device 138 between the recycling tank 104 and the mixing tank 106 and the valve device 148 between the mixing tank 106 and the first fresh tank 110 to switch off. When the liquid level of the inkjet-printing material in the mixing tank 106 is lower than a position of the low level detector 146, the valve device 150 can switch off the channel between the mixing tank 106 and the buffer tank 114.

Referring to FIG. 1 again, the flow meters 140 and 152 can inform the controller 124 about the flow rate of the inkjet-printing material in the recycling tank 104 and the flow rate of the inkjet-printing material in the first fresh tank 110, so as to control a mixture ratio of the mixed inkjet-printing material in the mixing tank 106. The controller 124 can utilize the valve devices 140 and 148 to control the mixture ratio, so as to allow the mixture ratio within a predetermined mixture ratio range for enhancing the quality of the mixed inkjet-printing material. In this embodiment, the mixed inkjet-printing material in the mixing tank 106 may be the PI liquid. At this time, the mixture ratio of the inkjet-printing material from the recycling tank 104 and the fresh inkjet-printing material from the first fresh tank 110 can be in the predetermined range of 1:2 to 1:5.

Referring to FIG. 1 again, the buffer tank 114 can receive the mixed inkjet-printing material from the mixing tank 106 and the fresh inkjet-printing material from the second fresh tank 112, so as to provide the usable inkjet-printing material to the nozzles 101 of the inkjet-printing apparatus.

In another embodiment, the second fresh tank 112 and the buffer tank 114 can include valve device (not shown) controlled by the controller 124. When the inkjet-printing material in the mixing tank 106 is insufficient to provide for the buffer tank 114, the controller 124 can control the valve device to switch on the channel between the second fresh tank 112 and the buffer tank 114, so as to directly provide the inkjet-printing material from the second fresh tank 112 to the buffer tank 114 for ensuring that the inkjet-printing material is sufficient to provide for the nozzles 101.

Figure 2:
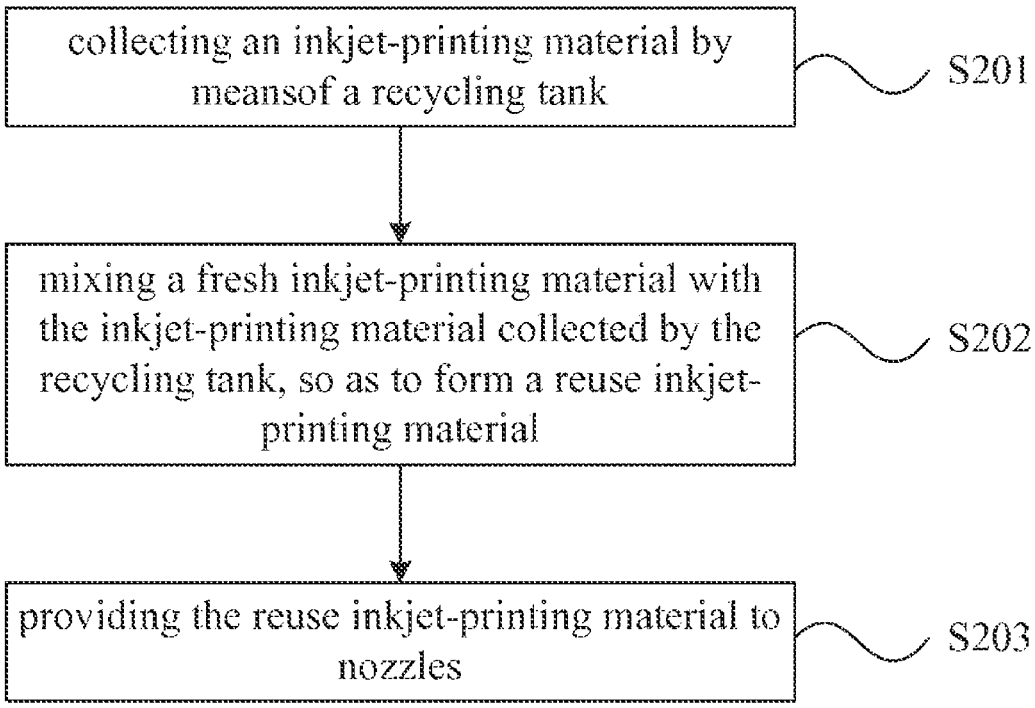
FIG. 2 is a flowchart showing a method for recycling the inkjet-printing material according to the present invention.

Referring to FIG. 2, a flowchart showing a method for recycling the inkjet-printing material according to the present invention is illustrated. When utilizing the material recycling system 100 to recycle the inkjet-printing material, firstly, the wiper 102 can withdraw the inkjet-printing material dispensed by the nozzles 101, and the dispensed inkjet-printing material is collected by the recycling tank 104 (step 201). The viscosity sensor 128 of the recycling tank 104 is utilized to detect whether the viscosity of the inkjet-printing material in the recycling tank 104 is in the predetermined range, so as to ensure the quality of the inkjet-printing material in the recycling tank 104. When the viscosity of the inkjet-printing material in the recycling tank 104 is in the predetermined range, the inkjet-printing material in the recycling tank 104 can be provided for the mixing tank 106. When the viscosity of the inkjet-printing material in the recycling tank 104 is beyond the predetermined range, the inkjet-printing material in the recycling tank 104 is scrapped to the waste tank 108. Subsequently, the mixing tank 106 is utilized to mix the fresh inkjet-printing material from the first fresh tank 110 with the inkjet-printing material from the recycling tank 104, so as to form the reuse inkjet-printing material (step 202). At this time, the controller 124 can use the valve devices 138 and 148 to control the mixture ratio of the mixed inkjet-printing material in the mixing tank 106, so as to allow the mixture ratio within the predetermined mixture ratio range for enhancing the quality of the mixed inkjet-printing material. Subsequently, the mixing tank 106 can provide the reuse inkjet-printing material to the nozzle through the buffer tank 114 (step 203). At this time, the mixing tank 106 can first provide the mixed reuse inkjet-printing material to the buffer tank 114, and the second fresh tank 112 can also provides the fresh inkjet-printing material to the buffer tank 114, and then buffer tank 114 can provide the reuse inkjet-printing material to the nozzle 101 of the inkjet-printing apparatus.

As described above, the system and the method of the present invention for recycling the inkjet-printing material can recycle the inkjet-printing material which is not used efficiently. The recycled inkjet-printing material is mixed with the fresh inkjet-printing material to form the reuse inkjet-printing material for providing to the nozzle of the inkjet-printing apparatus. Therefore, the system and the method of the present invention for recycling the inkjet-printing material can efficiently recycle the unused inkjet-printing material for greatly saving the inkjet-printing material and reducing the cost of the inkjet-printing process. In particular, the system and the method of the present invention for recycling the inkjet-printing material is suitable to recycle a high-cost inkjet-printing material, such as the material of the alignment films (PI liquid)

The present invention has been described with a preferred embodiment thereof and it is understood that many changes and modifications to the described embodiment can be carried out without departing from the scope and the spirit of the invention that is intended to be limited only by the appended claims.

The invention claimed is:

1. A system for recycling an inkjet-printing material, comprising:

a wiper configured to clean nozzles and to withdraw the inkjet-printing material dispensed by the nozzles;

a recycling tank connected to the wiper and configured to collect the inkjet-printing material withdrew by the wiper;

a mixing tank connected between the recycling tank and the nozzles and configured to mix a fresh inkjet-printing material with the inkjet-printing material collected by the recycling tank, so as to form and provide a reuse inkjet-printing material to the nozzles, wherein a predetermined mixture ratio of the inkjet-printing material from the recycling tank and the fresh inkjet-printing material in the mixing tank is in the range of 1:2 to 1:5; and a buffer tank configured to receive the reuse inkjet-printing material and another fresh inkjet-printing material, so as to provide a usable inkjet-printing material to the nozzles;

wherein the recycling tank comprises a viscosity sensor configured to sense a viscosity of the inkjet-printing material in the recycling tank.

2. The system for recycling the inkjet-printing material according to claim 1, wherein the viscosity of the inkjet-printing material provided from the recycling tank to the mixing tank is in a predetermined range.

3. The system for recycling the inkjet-printing material according to claim 2, wherein the predetermined range is of 5 Mpa·s to 8 Mpa·s.

4. The system for recycling the inkjet-printing material according to claim 1, further comprising a waste tank, wherein, when the viscosity of the inkjet-printing material in the recycling tank is beyond the predetermined range, the inkjet-printing material in the recycling tank is scrapped to the waste tank.

5. The system for recycling the inkjet-printing material according to claim 1, wherein the recycling tank comprises a drying device configured to absorb the moisture content in the inkjet-printing material in the recycling tank.

6. A system for recycling an inkjet-printing material, comprising:

a wiper configured to clean nozzles and to withdraw the inkjet-printing material dispensed by the nozzles;

a recycling tank connected to the wiper and configured to collect the inkjet-printing material withdrew by the wiper;

a mixing tank connected between the recycling tank and the nozzles and configured to mix a fresh inkjet-printing material with the inkjet-printing material collected by the recycling tank, so as to form and provide a reuse inkjet-printing material to the nozzles; and a buffer tank configured to receive the reuse inkjet-printing material and another fresh inkjet-printing material, so as to provide a usable inkjet-printing material to the nozzles;

wherein the recycling tank comprises a viscosity sensor configured to sense a viscosity of the inkjet-printing material in the recycling tank.

7. The system for recycling the inkjet-printing material according to claim 6, wherein a predetermined mixture ratio of the inkjet-printing material from the recycling tank and the fresh inkjet-printing material in the mixing tank is in the range of 1:2 to 1:5.

8. The system for recycling the inkjet-printing material according to claim 6, wherein the viscosity of the inkjet-printing material provided from the recycling tank to the mixing tank is in a predetermined range.

9. The system for recycling the inkjet-printing material according to claim 8, wherein the predetermined range is of 5 Mpa·s to 8 Mpa·s.

10. The system for recycling the inkjet-printing material according to claim 6, further comprising a waste tank, wherein, when the viscosity of the inkjet-printing material in the recycling tank is beyond a predetermined range, the inkjet-printing material in the recycling tank is scrapped to the waste tank.

11. The system for recycling the inkjet-printing material according to claim 6, wherein the recycling tank comprises a drying device configured to absorb the moisture content in the inkjet-printing material in the recycling tank.

* * * * *